US008056730B2

(12) United States Patent
Molteni

(10) Patent No.: US 8,056,730 B2
(45) Date of Patent: Nov. 15, 2011

(54) MAGNETIC SEPARATOR FOR FERROMAGNETIC MATERIALS WITH CONTROLLED-SLIP ROTATING ROLLER AND RELEVANT OPERATING METHODS

(75) Inventor: Danilo Molteni, Manerbio (IT)

(73) Assignee: SGM Gantry S.p.A., Manerbio BS (IT)

( * ) Notice: Subject to any disclaimer, the term of this patent is extended or adjusted under 35 U.S.C. 154(b) by 105 days.

(21) Appl. No.: 11/568,793

(22) PCT Filed: Jun. 7, 2004

(86) PCT No.: PCT/IT2004/000330

§ 371 (c)(1),
(2), (4) Date: Nov. 7, 2006

(87) PCT Pub. No.: WO2005/120714

PCT Pub. Date: Dec. 22, 2005

(65) Prior Publication Data

US 2007/0221542 A1 Sep. 27, 2007

(51) Int. Cl.
*B03C 1/00* (2006.01)

(52) U.S. Cl. ..... 209/219

(58) Field of Classification Search ..... 209/214, 209/219, 218, 221

See application file for complete search history.

(56) References Cited

U.S. PATENT DOCUMENTS

| | | | | | |
|---|---|---|---|---|---|
| 3,430,870 | A * | 3/1969 | Weston | ..... | 241/34 |
| 3,926,792 | A * | 12/1975 | Buford | ..... | 209/636 |
| 4,504,505 | A * | 3/1985 | Rodriguez et al. | ..... | 426/482 |
| 5,092,986 | A * | 3/1992 | Feistner et al. | ..... | 209/212 |
| 5,101,980 | A * | 4/1992 | Arvidson | ..... | 209/546 |
| 5,394,991 | A * | 3/1995 | Kumagai et al. | ..... | 209/212 |
| 6,068,133 | A | 5/2000 | Schoenfeld et al. | | |
| 6,358,319 | B1 * | 3/2002 | Huykman et al. | ..... | 118/308 |
| 2002/0112665 | A1 | 8/2002 | Huykman et al. | | |

FOREIGN PATENT DOCUMENTS

| | | |
|---|---|---|
| DE | 10122569 | 9/2006 |
| EP | 0 106 675 | 10/1983 |
| EP | 0 342 330 | 3/1989 |
| EP | 0861124 | 8/2001 |

* cited by examiner

*Primary Examiner* — Joseph C Rodriguez
*Assistant Examiner* — Kalyanavenkateshware Kumar
(74) *Attorney, Agent, or Firm* — Lucas & Mercanti, LLP

(57) ABSTRACT

A magnetic separator conventionally includes a conveyor belt (1) that forms a closed loop around a magnetic roller (2) and an idler roller (3) to convey a mix of materials (4), the novel aspect being that the belt (1) is not driven by the roller (2) but by the idler roller (3) that is motorized, and in that the belt (1) is not wound directly on the roller (2) but on an idle tube (3') of non-magnetic material inside which the roller (2) is arranged with a minimum gap. It is therefore possible to obtain two surfaces with a relative slip and therefore two different speeds whereby the attracted material, during the path defined by the 180° of tangency to the magnetic area, due to the backing or advancing of the magnetic polarities tends to rotate backward or forward with respect to the travel direction of the belt. This results in substantially all the inert material being released and falling by gravity in a first fall area (5) located below the vertical tangent to the belt (1), and also in a progressive release of materials with increasing permeability, with a fan-like detachment that leads them to fall into distinct fall areas (6, 7, 8).

16 Claims, 2 Drawing Sheets

MAGNETIC SEPARATOR FOR FERROMAGNETIC MATERIALS WITH CONTROLLED-SLIP ROTATING ROLLER AND RELEVANT OPERATING METHODS

FIELD OF THE INVENTION

The present invention relates to machines for separating materials according to their magnetic properties, and in particular to a separator with controlled-slip rotating roller.

BACKGROUND OF THE INVENTION

It is known that a magnetic separator is designed to extract from a flow of mixed materials all those parts having magnetic permeability, so as to separate them from the rest of the inert material. A typical separator essentially consists of a magnetic pulley, acting as driving roller, which draws a belt that conveys a mix of materials, the belt being closed in a loop around a return roller.

Magnetic pulleys with different magnetic field gradient suitable to separate materials with high or low magnetic permeability are used to select the material. With a low field gradient only materials with high magnetic permeability are attracted, whereas with a high field gradient both high magnetic permeability and low magnetic permeability materials are attracted.

A drawback of known separators, in particular those with high field gradient pulley, is that the material attracted by the corresponding polarities remains attached to those polarities until the conveyor belt moves away from the roller thus causing the detachment of the attracted material in a very small area. As a consequence, both low magnetic permeability and high magnetic permeability materials fall in the same area and have to be subsequently sorted.

Another drawback stems from the fact that the magnetic materials bring along a portion of the inert material, since the latter remains pinched between the inductor (the alternate polarities of the roller) and the induced (the attracted magnetic material). Therefore also in this case a further working is required to increase the quality of the selected material.

Another type of magnetic separator is the eddy current separator that is used to separate non-magnetic yet electrically conductive materials such as aluminum, copper, brass, etc. In this case there is provided a magnetic roller that rotates at high speed inside a non-magnetic tube around which the conveyor belt is wound.

The rotational speed of the roller must be very high (e.g. 3000 rpm) to induce in the conductive materials the eddy currents that in turn due to the fast variation of the magnetic field cause a repulsion of said materials that are thus separated from the mix. Moreover, in order to achieve the maximum operational efficiency the gap between the magnetic roller and the non-magnetic tube must be as small as possible, and this can cause overheating problems due to the high relative rotational speed between the two members. An example of such a separator for conductive materials is found in U.S. Pat. No. 5,394,991.

SUMMARY OF THE INVENTION

Therefore the object of the present invention is to provide a separator that is free from the above-mentioned drawbacks. This object is achieved by means of a separator for ferromagnetic materials in which the return roller acts as driving roller for the belt that is wound around an idle tube inside which a magnetic roller can rotate at a speed different from the tube speed, in a way similar to what occurs in an eddy current separator but in a completely different speed range.

A first great advantage of this separator comes from the fact that the control of the roller speed with respect to the belt speed allows to obtain a relative slip that greatly reduces the pinch effect'sand therefore the probability of bringing inert material along with the magnetic material.

Another great advantage is that the controlled slip allows also to obtain an immediate selection of the materials having different magnetic permeability, by opening them fan-like in a fall area with a progressive release of materials of increasing permeability.

BRIEF DESCRIPTION OF THE DRAWINGS

Further advantages and characteristics of the separator according to the present invention will be clear to those skilled in the art from the following detailed description of some embodiments thereof, with reference to the annexed drawings wherein.

DETAILED DESCRIPTION OF THE PREFERRED EMBODIMENTS

Figure 1:
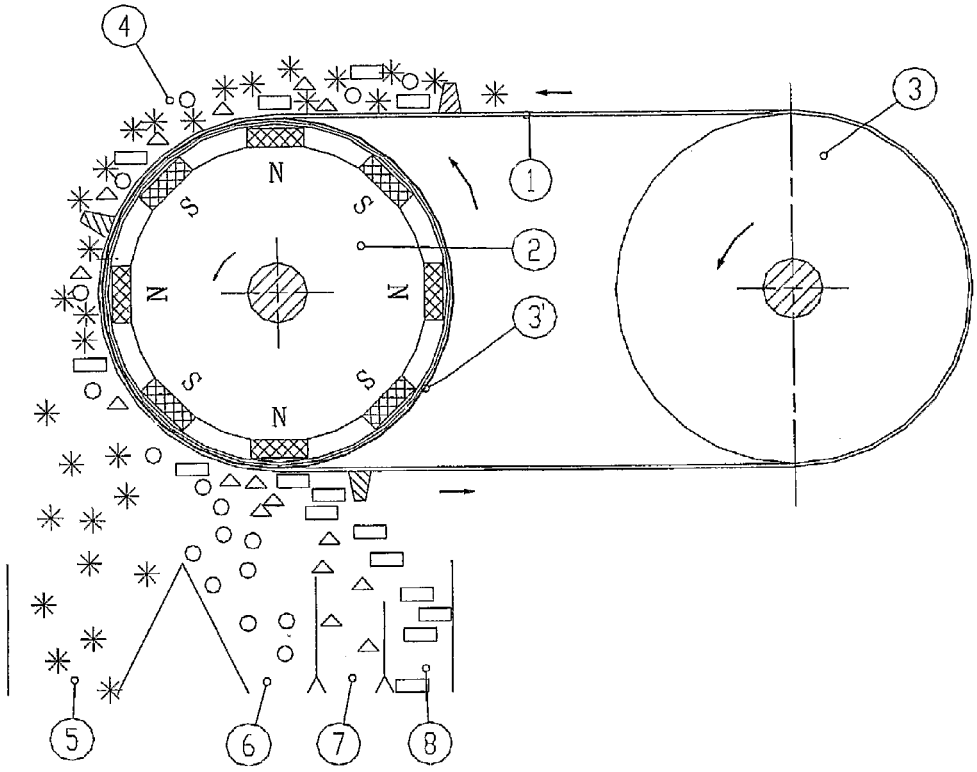
FIG. 1 is a diagrammatic longitudinal sectional view showing the material separation and selection effect achieved by the present separator.
Figure 2:
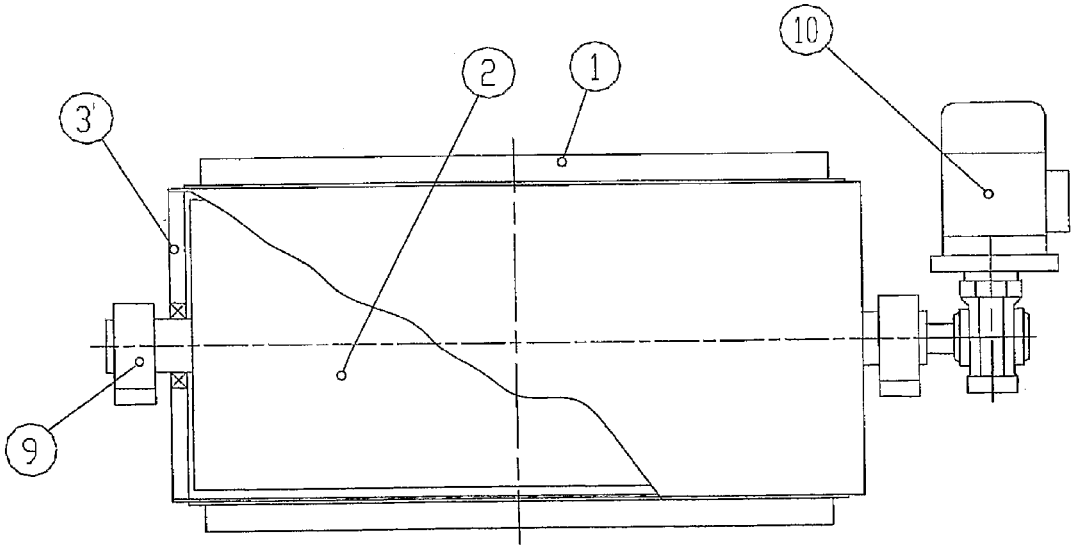
FIG. 2 is a diagrammatic front view showing a first embodiment of the controlled slip system.

Referring to FIGS. 1 and 2, there is seen that a magnetic separator according to the present invention conventionally includes a conveyor belt 1 that. forms a closed loop around a magnetic roller 2 and a return roller 3 to convey a mix of materials 4. In said mix 4 the magnetic properties of the materials have been graphically indicated as follows: the star for inert material, the circle for low magnetic permeability material, the triangle for medium magnetic permeability material, and the rectangle for high magnetic permeability material.

The novel aspect of the present invention is given by the fact that in this separator for ferromagnetic materials there is used a structure similar to a separator for non-magnetic materials: belt 1 is not driven by roller 2 but by the return roller 3 that is motorized, and it is not wound directly on roller 2 but on an idle tube 3' of non-magnetic material (e.g. stainless steel, glass reinforced plastic, etc.) inside which roller 2 is arranged with a minimum gap.

As illustrated in FIG. 2, roller 2 is supported at the end of its shaft by bearings 9 while tube 3' is in turn supported by the shaft of roller 2 on which it is mounted through bearings. The rotational speed of roller 2 is controlled by means of a motor-reducer 10, or the like, so that its angular velocity is comprised between 1% and 200% of the angular velocity of belt 1, and in any case different from 100% so that there is a difference that results in a relative rotation between roller 2 and tube 3'.

The aim of this difference is that of obtaining two surfaces with a relative slip and therefore two different speeds whereby the attracted material, during the path defined by the 180° of tangency to the magnetic area, due to the backing or advancing of the magnetic polarities tends to rotate backward or forward with respect to the travel direction of the belt.

This results in obtaining that substantially all the inert material is released and falls by gravity in a first fall area 5 located below the vertical tangent to belt 1. Furthermore, also the above-mentioned progressive release of materials with increasing permeability is obtained, with a fan-like detachment that leads them to fall into distinct fall areas 6, 7 and 8.

In other words, the greater is the magnetic permeability of the material and the greater is its capacity to resist the combined action of slip and centrifugal force. As a consequence, each material will leave belt 1 at the point corresponding to its magnetic properties, without the pinch effect caused by materials with higher magnetic permeability affecting its fall area.

It should be noted that although the preferred embodiment provides the use of motor-reducer 10 to control the speed or roller 2, said speed can also be controlled (though over a smaller speed range) simply by means of a clutch keyed on the shaft of roller 2. In fact, in the absence of motor-reducer 10, the passage itself of ferromagnetic materials on belt 1 tends to draw into rotation roller 2 that being idle only has the rotational friction of bearings 9, once the initial inertia is overcome.

This is obviously possible only when mix 4 has a sufficient concentration of ferromagnetic material, whereas if the concentration is low or the present material has low magnetic permeability roller 2 could be totally void of drive or clutch means since the friction of bearings 9 and/or its inertia is sufficient to keep its speed below the speed of belt 1.

Clearly in these two instances the speed of roller 2 can only be lower than that of belt 1, but in general also with the motor-reducer 10 is it preferable to rotate roller 2 at a speed lower than belt 1 even if the motor driving can allow it to rotate at a higher speed whenever this is useful for a more effective selection of the materials.

Figure 3:
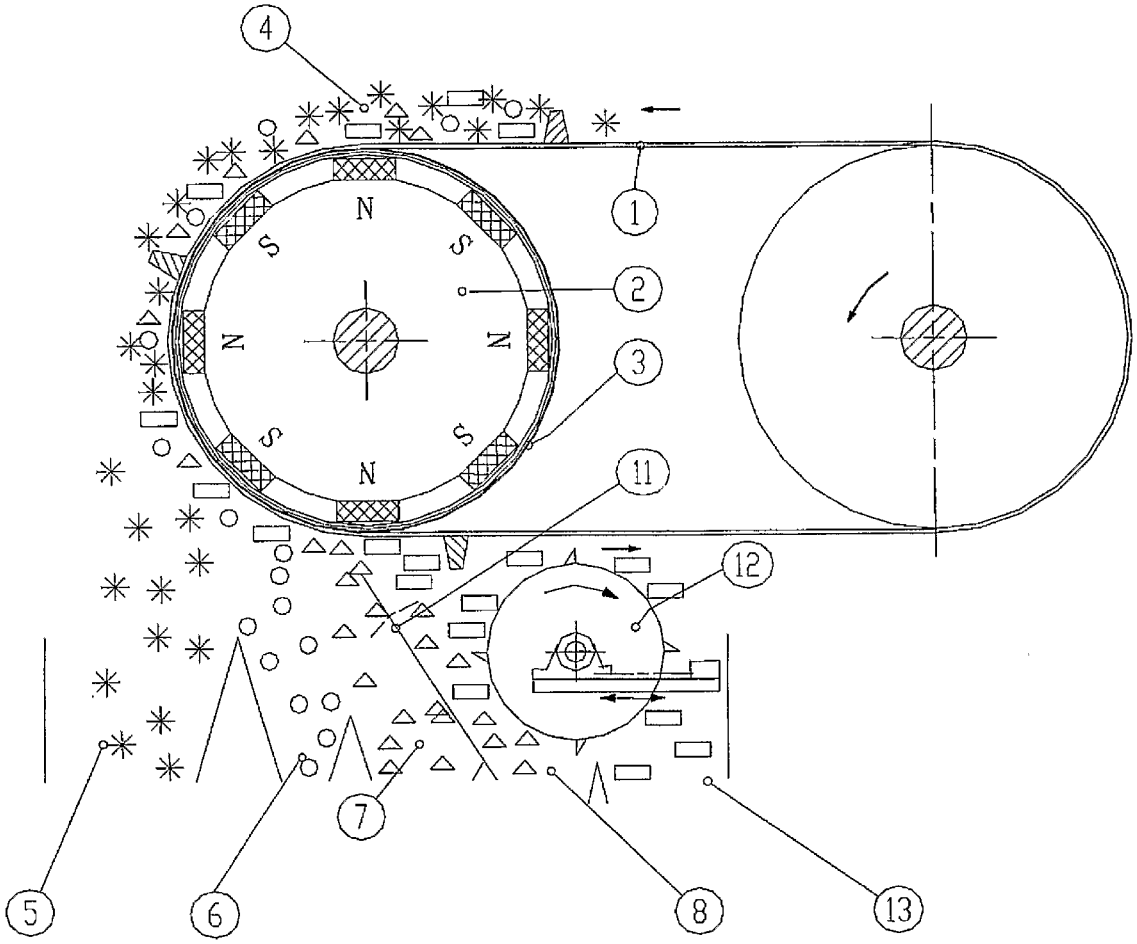
FIG. 3 is a diagrammatic view similar to FIG. 1 showing a modification of the present separator provided with an additional device for the selection of high magnetic permeability materials.

Regardless of the type of roller 2 used (motor-driven, clutched or idle), the selection of the material with higher magnetic permeability can be enhanced through the embodiment illustrated in FIG. 3.

In this case the above-described separator has been added with an adjustable inclination deflector 11 to deviate, according to the previously set inclination, the material with higher or lower magnetic permeability toward a magnetic drum 12, preferably with permanent magnets, whose cover rotates in the opposite direction with respect to roller 2.

The position of drum 12 is preferably adjustable so that it allows to extract the material with higher magnetic permeability from the flow of material deviated by deflector 11 toward the fall area 8, which material is then overturned by the counter-rotating drum 12 and subsequently released in the collection area 13. The addition of deflector 11 and drum 12, as well as their adjustability, allow to extend the field of application of the present separator.

It is clear that the above-described and illustrated embodiments of the magnetic separator according to the invention are just examples susceptible of various modifications. In particular, roller 2 is preferably of the permanent magnets type and it can be made with magnets of different nature and with different magnetic circuits such as a circuit with high gradient (50÷300 Oe/cm), very high gradient (300÷1000 Oe/cm) and ultra-high gradient (1000÷2000 Oe/cm), but it could also be of the electromagnetic type.

Similarly, belt 1, tube 3' and the driving roller 3 can be modified according to specific manufacturing needs, and more than one return roller can be provided depending on the shape and/or length of belt 1.

The invention claimed is:

1. A magnetic separator for separating ferromagnetic materials having different magnetic permeability according to the different magnetic permeability of the materials, comprising:

a rotatable magnetic roller;

a non-magnetic idler tube around the rotatable magnetic roller so that the idler tube can slip rotationally with respect to the rotatable magnetic roller;

a motor-driven roller;

a belt around the idler tube and rotatable magnetic roller to form a closed loop around the rotatable magnetic roller and the motor-driven roller, which belt moves at the angular velocity of the motor-driven roller; and means for adjusting the angular velocity of the rotatable magnetic roller within a range of about 1% to 200% of the belt angular velocity, means for causing the ferromagnetic materials having higher magnetic permeability to adhere more strongly to the belt as it encircles the idler tube due to the magnetic attraction of the rotatable magnetic roller, means for causing release of the inert material to fall by gravity, means for causing the ferromagnetic material, due to the backing or advancing of the magnetic polarities, to rotate backward or forward respectively with respect to the travel direction of the belt; and means for causing the ferromagnetic materials to be released to and fall into different fall areas having ranges of increasing magnetic permeability at positions moving inwardly from below the edge of the belt due to the greater the magnetic permeability of the ferromagnetic material, the greater is its capacity to resist the combined action of slip and centrifugal force.

2. The magnetic separator according to claim 1, characterized in that the means for controlling the angular velocity of the magnetic roller (2) consist of a motor-reducer (10).

3. The magnetic separator according to claim 1, characterized in that the means for controlling the angular velocity of the magnetic roller (2) consist of a clutch keyed on the shaft of the magnetic roller (2).

4. The magnetic separator according to one of claims 1, 2, or 3, characterized in that the magnetic roller (2) is supported at the end of its shaft by bearings (9) and the idle tube (3') is in turn mounted through bearings on said shaft of the magnetic roller (2).

5. The magnetic separator according to one of claim 1, 2, or 3, characterized in that it further includes an adjustable inclination deflector (11) located under the magnetic roller (2).

6. The magnetic separator according to one of claims 1, 2, or 3, characterized in that it further includes a magnetic drum (12) whose cover rotates in the opposite direction with respect to the magnetic roller (2) and is located at a fall area (8) of the material with high magnetic permeability.

7. The magnetic separator according to claim 6, characterized in that the position of the magnetic drum (12) is adjustable.

8. The magnetic separator according to claim 6, characterized in that the magnetic drum (12) includes permanent magnets.

9. The magnetic separator according to claim 4, characterized in that it further includes an adjustable inclination deflector (11) located under the magnetic roller (2).

10. The magnetic separator according to claim 4, characterized in that it further includes a magnetic drum (12) whose cover rotates in the opposite direction with respect to the magnetic roller (2) and is located at a fall area (8) of the material with high magnetic permeability.

11. The magnetic separator according to claim 5, characterized in that it further includes a magnetic drum (12) whose cover rotates in the opposite direction with respect to the magnetic roller (2) and is located at a fall area (8) of the material with high magnetic permeability.

12. The magnetic separator according to claim 10, characterized in that the position of the magnetic drum (12) is adjustable.

13. The magnetic separator according to claim 10, characterized in that the magnetic drum (12) includes permanent magnets.

14. The magnetic separator according to claim 11, characterized in that the position of the magnetic drum (12) is adjustable.

15. The magnetic separator according to claim 11, characterized in that the magnetic drum (12) includes permanent magnets.

16. A method for separating ferromagnetic materials having different magnetic permeability according to the different magnetic permeability of the materials, comprising:

providing a rotatable magnetic roller;

providing a non-magnetic idler tube around the rotatable magnetic roller so that the idler tube can slip rotationally with respect to the rotatable magnetic roller;

providing a motor-driven roller;

providing a belt around the idler tube and rotatable magnetic roller to form a closed loop around the rotatable magnetic roller and the motor-driven roller;

providing a means for adjusting the angular velocity of the rotatable magnetic roller;

providing a mix of materials of inert material and ferromagnetic materials having different magnetic permeability on the belt;

moving the belt at an angular velocity; and adjusting the angular velocity of the rotatable magnetic roller within a range of about 1% to 200% of the belt angular velocity, wherein the ferromagnetic materials having higher magnetic permeability adhere more strongly to the belt as it encircles the idler tube due to the magnetic attraction of the rotatable magnetic roller, wherein the inert material is released and falls by gravity, and wherein the ferromagnetic material, due to the backing or advancing of the magnetic polarities, tends to rotate backward or forward with respect to the travel direction of the belt, and the greater is the magnetic permeability of the ferromagnetic material, and the greater is its capacity to resist the combined action of slip and centrifugal force, whereby the ferromagnetic materials are released and fall into different fall areas having ranges of increasing magnetic permeability at positions moving inwardly from below the edge of the belt.

* * * * *